US010937589B2

(12) United States Patent
Suzuki

(10) Patent No.: US 10,937,589 B2
(45) Date of Patent: Mar. 2, 2021

(54) COIL COMPONENT AND METHOD OF MANUFACTURING THE SAME

(71) Applicant: TDK CORPORATION, Tokyo (JP)

(72) Inventor: Masanori Suzuki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 214 days.

(21) Appl. No.: 15/928,759

(22) Filed: Mar. 22, 2018

(65) Prior Publication Data

US 2018/0286568 A1 Oct. 4, 2018

(30) Foreign Application Priority Data

Mar. 29, 2017 (JP) ..... JP2017-064821

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/12*** | (2006.01) |
| ***H01F 41/04*** | (2006.01) |
| ***H01F 27/32*** | (2006.01) |
| *H01F 27/38* | (2006.01) |
| *H01F 3/10* | (2006.01) |

(52) U.S. Cl.

CPC ..... *H01F 27/2876* (2013.01); *H01F 27/292* (2013.01); *H01F 27/323* (2013.01); *H01F 41/04* (2013.01); *H01F 41/122* (2013.01); *H01F 3/10* (2013.01); *H01F 27/38* (2013.01)

(58) Field of Classification Search

CPC ..... H01F 41/10

USPC ..... 336/200

See application file for complete search history.

(56) References Cited

U.S. PATENT DOCUMENTS

| | | | |
|---|---|---|---|
| 5,515,022 | A | 5/1996 | Tashiro et al. |
| 6,459,351 | B1 | 10/2002 | Maki et al. |
| 6,504,466 | B1 | 1/2003 | Katsurada |
| 7,091,816 | B1 | 8/2006 | Ito et al. |
| 8,633,793 | B1 | 1/2014 | Chang et al. |
| 10,566,126 | B2 * | 2/2020 | Shimoichi ..... H01F 17/0006 |
| 2001/0026017 | A1 | 10/2001 | Seto |
| 2001/0054472 | A1 | 12/2001 | Okuyama et al. |
| 2002/0027282 | A1 | 3/2002 | Kawakami et al. |

(Continued)

FOREIGN PATENT DOCUMENTS

| | | |
|---|---|---|
| JP | H5-160344 A | 6/1993 |
| JP | H7-176444 A | 7/1995 |

(Continued)

*Primary Examiner* — Ronald Hinson
(74) *Attorney, Agent, or Firm* — Oliff PLC

(57) ABSTRACT

In a coil component, in an upper coil portion, a winding end portion constituting an end portion is connected to a lead-out conductor. Accordingly, the lead-out conductor can absorb heat from the winding end portion and can dissipate heat to the outside via a terminal electrode. Moreover, the lead-out conductor is formed to cover a winding adjacent portion. Accordingly, heat can also be absorbed from the winding adjacent portion and can be dissipated to the outside via the terminal electrode. That is, in the coil component described above, since the lead-out conductor absorbs heat not only from the winding end portion but also from the winding adjacent portion, improvement of heat dissipation properties is realized in the coil component.

5 Claims, 10 Drawing Sheets

(56) References Cited

U.S. PATENT DOCUMENTS

| | | | |
|---|---|---|---|
| 2002/0093415 | A1 | 7/2002 | Kitamura |
| 2003/0164533 | A1 | 9/2003 | Tada et al. |
| 2004/0141297 | A1 | 7/2004 | Tokuda et al. |
| 2005/0118969 | A1 | 6/2005 | Shoji |
| 2005/0181684 | A1 | 8/2005 | Ito et al. |
| 2005/0253677 | A1 | 11/2005 | Ito et al. |
| 2006/0097835 | A1 | 5/2006 | Tomonari et al. |
| 2006/0176138 | A1 | 8/2006 | Ito et al. |
| 2006/0238273 | A1 | 10/2006 | Tomonari et al. |
| 2007/0040163 | A1 | 2/2007 | Okuzawa et al. |
| 2007/0057755 | A1 | 3/2007 | Suzuki et al. |
| 2007/0199734 | A1 | 8/2007 | Kudo et al. |
| 2007/0205856 | A1 | 9/2007 | Matsunaga et al. |
| 2008/0012679 | A1 | 1/2008 | Okabe et al. |
| 2008/0100409 | A1 | 5/2008 | Nishikawa et al. |
| 2008/0130258 | A1 | 6/2008 | Kudo et al. |
| 2008/0303621 | A1 | 12/2008 | Ito et al. |
| 2009/0115563 | A1 | 5/2009 | Arata et al. |
| 2009/0201005 | A1 | 8/2009 | Noma et al. |
| 2009/0267721 | A1 | 10/2009 | Okada et al. |
| 2009/0284340 | A1 | 11/2009 | Nishikawa et al. |
| 2010/0141374 | A1 | 6/2010 | Hopper et al. |
| 2010/0157565 | A1 | 6/2010 | Yoshida et al. |
| 2010/0176484 | A1 | 7/2010 | Asakura et al. |
| 2010/0328009 | A1 | 12/2010 | Tawa |
| 2010/0328010 | A1 | 12/2010 | Noma et al. |
| 2011/0002075 | A1 | 1/2011 | Asakawa et al. |
| 2011/0007439 | A1 | 1/2011 | Asakawa et al. |
| 2011/0025442 | A1 | 2/2011 | Hsieh et al. |
| 2011/0050191 | A1 | 3/2011 | Tsuji et al. |
| 2011/0050380 | A1 | 3/2011 | Nakanishi |
| 2011/0163832 | A1 | 7/2011 | Ueno |
| 2011/0291790 | A1 | 12/2011 | Okumura et al. |
| 2012/0068301 | A1 | 3/2012 | Sin et al. |
| 2012/0086538 | A1 | 4/2012 | Chu |
| 2012/0112869 | A1 | 5/2012 | Nishikawa et al. |
| 2012/0119863 | A1 | 5/2012 | Wu |
| 2012/0133472 | A1 | 5/2012 | Nishikawa et al. |
| 2012/0274148 | A1 | 11/2012 | Sung et al. |
| 2012/0306609 | A1 | 12/2012 | Kato |
| 2013/0015937 | A1 | 1/2013 | Seko |
| 2013/0112651 | A1 | 5/2013 | Lee et al. |
| 2013/0141206 | A1 | 6/2013 | Lee et al. |
| 2013/0147595 | A1 | 6/2013 | Lee et al. |
| 2013/0154770 | A1 | 6/2013 | Lee et al. |
| 2013/0169399 | A1 | 7/2013 | Yoo et al. |
| 2013/0222101 | A1 | 8/2013 | Ito et al. |
| 2013/0314189 | A1 | 11/2013 | Okumura et al. |
| 2013/0314190 | A1 | 11/2013 | Yokoyama et al. |
| 2013/0314194 | A1 | 11/2013 | Sato |
| 2013/0342301 | A1 | 12/2013 | Mano et al. |
| 2014/0009254 | A1 | 1/2014 | Ohkubo et al. |
| 2014/0132385 | A1 | 5/2014 | Maruyama et al. |
| 2014/0133107 | A1 | 5/2014 | Chang et al. |
| 2014/0139307 | A1 | 5/2014 | Kido et al. |
| 2014/0145814 | A1 | 5/2014 | Lee et al. |
| 2014/0167902 | A1 | 6/2014 | Yoon et al. |
| 2014/0184377 | A1* | 7/2014 | Kim ..... H01F 17/0006 336/200 |
| 2014/0218150 | A1 | 8/2014 | Cho et al. |
| 2014/0266547 | A1 | 9/2014 | Watanabe et al. |
| 2014/0285303 | A1 | 9/2014 | Cho et al. |
| 2014/0306792 | A1 | 10/2014 | Yoneda et al. |
| 2014/0375412 | A1 | 12/2014 | Seko |
| 2015/0097648 | A1 | 4/2015 | Kido et al. |
| 2015/0102887 | A1 | 4/2015 | Park |
| 2015/0130581 | A1 | 5/2015 | Sim et al. |
| 2015/0145627 | A1 | 5/2015 | Sim et al. |
| 2015/0145629 | A1 | 5/2015 | Chang et al. |
| 2015/0325363 | A1 | 11/2015 | Chang et al. |
| 2015/0357115 | A1 | 12/2015 | Ohkubo et al. |
| 2016/0104569 | A1 | 4/2016 | Kato et al. |
| 2016/0247630 | A1 | 8/2016 | Kido et al. |
| 2017/0169930 | A1* | 6/2017 | Kudo ..... H01F 17/04 |
| 2019/0066908 | A1 | 2/2019 | Ueda et al. |

FOREIGN PATENT DOCUMENTS

| | | | |
|---|---|---|---|
| JP | H8-162330 | A | 6/1996 |
| JP | H11-329841 | A | 11/1999 |
| JP | 2000-058322 | A | 2/2000 |
| JP | 2001-244124 | A | 9/2001 |
| JP | 2004-047849 | A | 2/2004 |
| JP | 2004-055572 | A | 2/2004 |
| JP | 2004-111552 | A | 4/2004 |
| JP | 2006-128335 | A | 5/2006 |
| JP | 2006-228983 | A | 8/2006 |
| JP | 2006-286884 | A | 10/2006 |
| JP | 2007-066973 | A | 3/2007 |
| JP | 2007-214448 | A | 8/2007 |
| JP | 2009-117664 | A | 5/2009 |
| JP | 2009-117665 | A | 5/2009 |
| JP | 2009-206169 | A | 9/2009 |
| JP | 2009-267077 | A | 11/2009 |
| JP | 2010-040701 | A | 2/2010 |
| JP | 2011-014747 | A | 1/2011 |
| JP | 2011-049220 | A | 3/2011 |
| JP | 2012-015493 | A | 1/2012 |
| JP | 2012-015494 | A | 1/2012 |
| JP | 2012-235079 | A | 11/2012 |
| JP | 2012-248629 | A | 12/2012 |
| JP | 2013-098257 | A | 5/2013 |
| JP | 2013-098258 | A | 5/2013 |
| JP | 2013-098259 | A | 5/2013 |
| JP | 2013-098281 | A | 5/2013 |
| JP | 2013-102160 | A | 5/2013 |
| JP | 2013-120939 | A | 6/2013 |
| JP | 2013-123055 | A | 6/2013 |
| JP | 2013-125966 | A | 6/2013 |
| JP | 2014-013815 | A | 1/2014 |
| JP | 2014-107559 | A | 6/2014 |
| JP | 2014-154839 | A | 8/2014 |
| JP | 2014-154875 | A | 8/2014 |
| JP | 2015-103817 | A | 6/2015 |
| WO | 2012/140805 | A1 | 10/2012 |
| WO | 2013/031880 | A1 | 3/2013 |
| WO | 2017/199461 | A1 | 11/2017 |

* cited by examiner

COIL COMPONENT AND METHOD OF MANUFACTURING THE SAME

CROSS-REFERENCE TO RELATED APPLICATIONS

This application is based upon and claims the benefit of priority from Japanese Patent Application No. 2017-064821, filed on 29 Mar. 2017, the entire content of which is incorporated herein by reference.

BACKGROUND OF THE INVENTION

Field of the Invention

This disclosure relates to a coil component and a method of manufacturing the same.

Related Background Art

As a coil component in the related art, for example, Japanese Unexamined Patent Publication No. 2001-244124 (Patent Literature 1) discloses a coil component including a planar coil and an external electrode that is provided to penetrate a ferrite magnetic film covering the planar coil.

In such a coil component described above, since the planar coil has predetermined electrical resistance, the planar coil generates heat at the time of operation thereof. Particularly, as in the coil component described above, in a configuration in which the planar coil is covered with a magnetic film, dissipation of heat generated in the planar coil to the outside cannot be sufficiently performed, so that coil characteristics may deteriorate.

This disclosure provides a coil component, in which heat dissipation properties are improved, and a method of manufacturing the same.

According to an aspect of this disclosure, there is provided a coil component including magnetic element body having a main surface and having a coil portion and a pair of lead-out conductors internally, the coil portion includes a coil, the pair of lead-out conductors extends along a coil axial direction of the coil respectively from both coil end portions of the coil to the main surface so as to penetrate the magnetic element body and is exposed on the main surface of the magnetic element body, and a pair of terminal electrodes provided on the main surface of the magnetic element body and connected electrically to the pair of lead-out conductors exposed on the main surface. The coil portion has a planar coil having a plurality of windings including the coil end portions and constituting at least a part of the coil, and an insulative layer formed on the coil. The lead-out conductor penetrates the insulative layer, is connected to a winding end portion constituting the coil end portion of the planar coil, and covers at least a part of a winding adjacent portion adjacent to the winding end portion, via the insulative layer.

In the coil component, if the planar coil generates heat when the coil component is in operation, the lead-out conductor connected to the winding end portion constituting the coil end portions of the planar coil can absorb heat from the winding end portion and can dissipate the heat to the outside via the terminal electrode. Moreover, the lead-out conductor can also absorb heat from a winding adjacent portion covered with the lead-out conductor via the insulative layer and can dissipate heat to the outside via the terminal electrode. In this manner, since the lead-out conductor absorbs heat not only from the winding end portion but also from the winding adjacent portion, improvement of heat dissipation properties is realized in the coil component.

In the coil component according to the aspect of this disclosure, the lead-out conductor covers a plurality of winding portions including the winding adjacent portion, via the insulative layer. In this case, the lead-out conductor can absorb heat from the plurality of winding portions covered with the lead-out conductor via the insulative layer and can dissipate heat to the outside via the terminal electrode. Therefore, heat dissipation properties can be further improved.

In the coil component according to the aspect of this disclosure, a thickness of the lead-out conductor is greater than a thickness of the planar coil. In this case, a lead-out conductor having a high thermal capacity can be achieved. Due to the high thermal capacity of the lead-out conductor, efficiency of heat transfer from the planar coil toward the lead-out conductor is enhanced, and heat dissipation to the outside via the terminal electrode is further improved.

In the coil component according to the aspect of this disclosure, the planar coil exhibits an annular shape including a straight part and a curved part when seen in the coil axial direction of the coil. The coil end portion connected to the lead-out conductor is positioned at the curved part of the planar coil. Since a curved part has more heat generating amount than a straight part in the planar coil, the coil end portions connected to the lead-out conductor are positioned at curved parts. Therefore, heat dissipation efficiency via the lead-out conductor can be improved.

According to another aspect of this disclosure, there is provided a method of manufacturing a coil component including steps of preparing a magnetic element body having a main surface and having a coil portion and a pair of lead-out conductors internally, the coil portion includes a coil, the pair of lead-out conductors extends along a coil axial direction of the coil respectively from both end portions of the coil to the main surface so as to penetrate the magnetic element body and is exposed on the main surface of the magnetic element body, and forming a pair of terminal electrodes connected electrically to the pair of lead-out conductors exposed on the main surface of the magnetic element body. The coil portion has a planar coil having a plurality of windings including the end portions and constituting at least a part of the coil, and an insulative layer formed on the coil. In the step of forming lead-out conductors, the lead-out conductor is formed to penetrate the insulative layer, to be connected to a winding end portion constituting the end portion of the planar coil, and to cover at least a part of a winding adjacent portion adjacent to the winding end portion, via the insulative layer.

In the method of manufacturing a coil component, in the step of forming lead-out conductors, the lead-out conductor is formed to penetrate the insulative layer, to be connected to a winding end portion constituting the coil end portion of the planar coil, and to cover at least a part of a winding adjacent portion adjacent to the winding end portion, via the insulative layer. Therefore, if the planar coil generates heat when the coil component is in operation, the lead-out conductor connected to the winding end portion constituting the coil end portions of the planar coil can absorb heat from the winding end portion and can dissipate the heat to the outside via the terminal electrode. Moreover, the lead-out conductor can also absorb heat from a winding adjacent portion covered with the lead-out conductor via the insulative layer and can dissipate heat to the outside via the terminal electrode. In this manner, since the lead-out conductor absorbs heat not only from the winding end portion but also from the winding adjacent portion, according to the method of manufacturing a coil component, it is possible to achieve a coil component in which heat dissipation properties are improved.

DESCRIPTION OF THE PREFERRED EMBODIMENTS

Hereinafter, with reference to the accompanying drawings, an embodiment of the present disclosure will be described in detail. In description, the same reference signs are applied to the same elements or elements having the same function, and duplicated description will be omitted.

Figure 1:
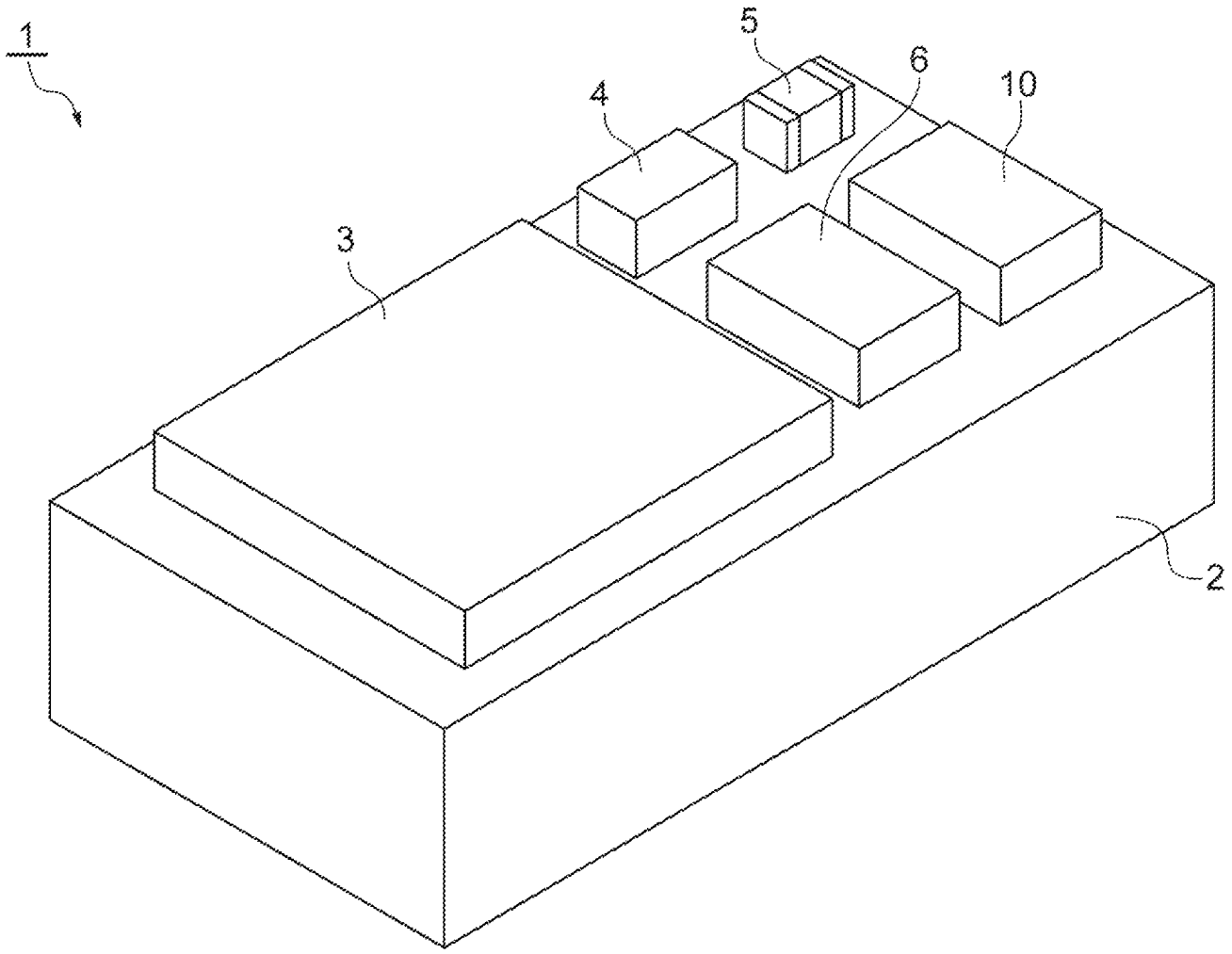
FIG. 1 is a perspective view illustrating a power supply circuit unit according to an embodiment of the present disclosure.
Figure 2:
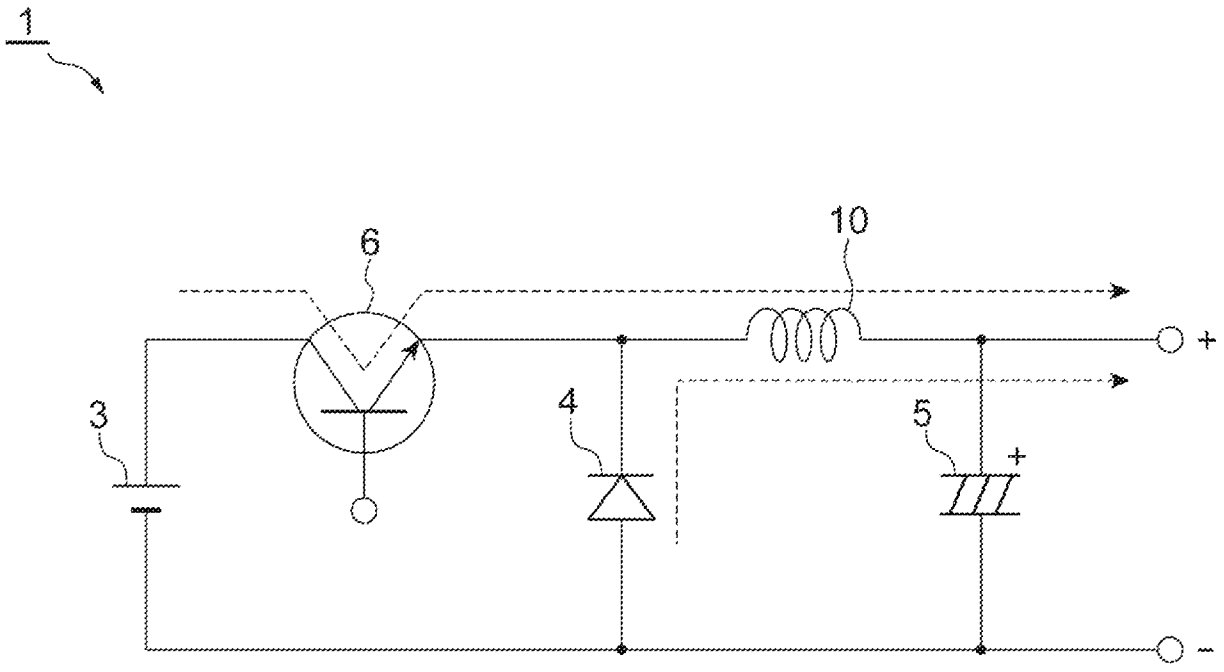
FIG. 2 is a view illustrating an equivalent circuit of the power supply circuit unit in FIG. 1.

First, with reference to FIGS. 1 and 2, an overall configuration of a power supply circuit unit 1 according to the embodiment of the present disclosure will be described. For example, a power supply circuit unit to be described in the present embodiment is a switching power supply circuit unit that converts (steps down) a direct voltage. As illustrated in FIGS. 1 and 2, the power supply circuit unit 1 includes a circuit substrate 2, electronic components 3, 4, 5, 6, and 10. Specifically, a power supply IC 3, a diode 4, a capacitor 5, a switching element 6, and a coil component 10 are configured to be mounted on the circuit substrate 2.

Figure 3:
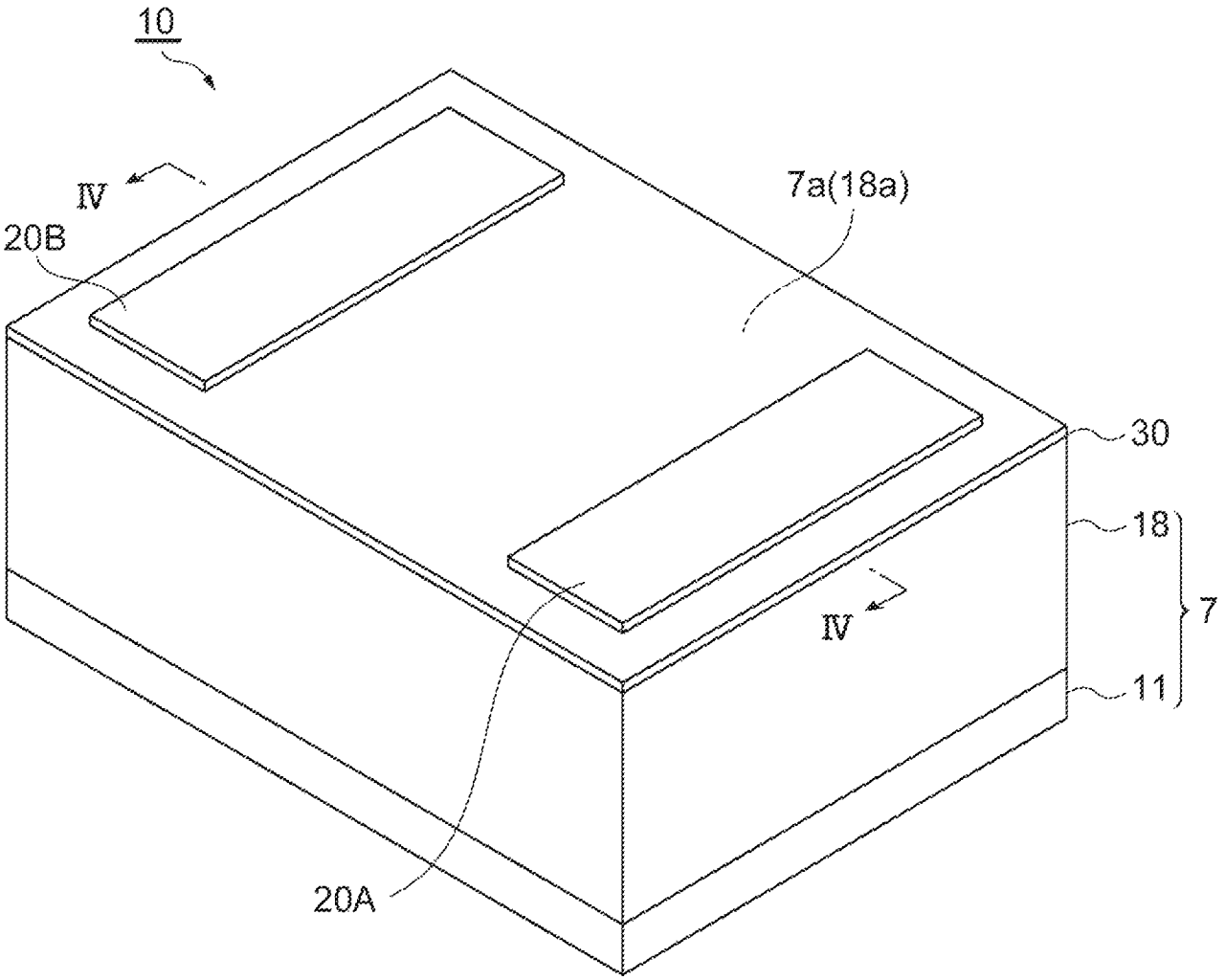
FIG. 3 is a perspective view of a coil component according to the embodiment of the present disclosure.
Figure 4:
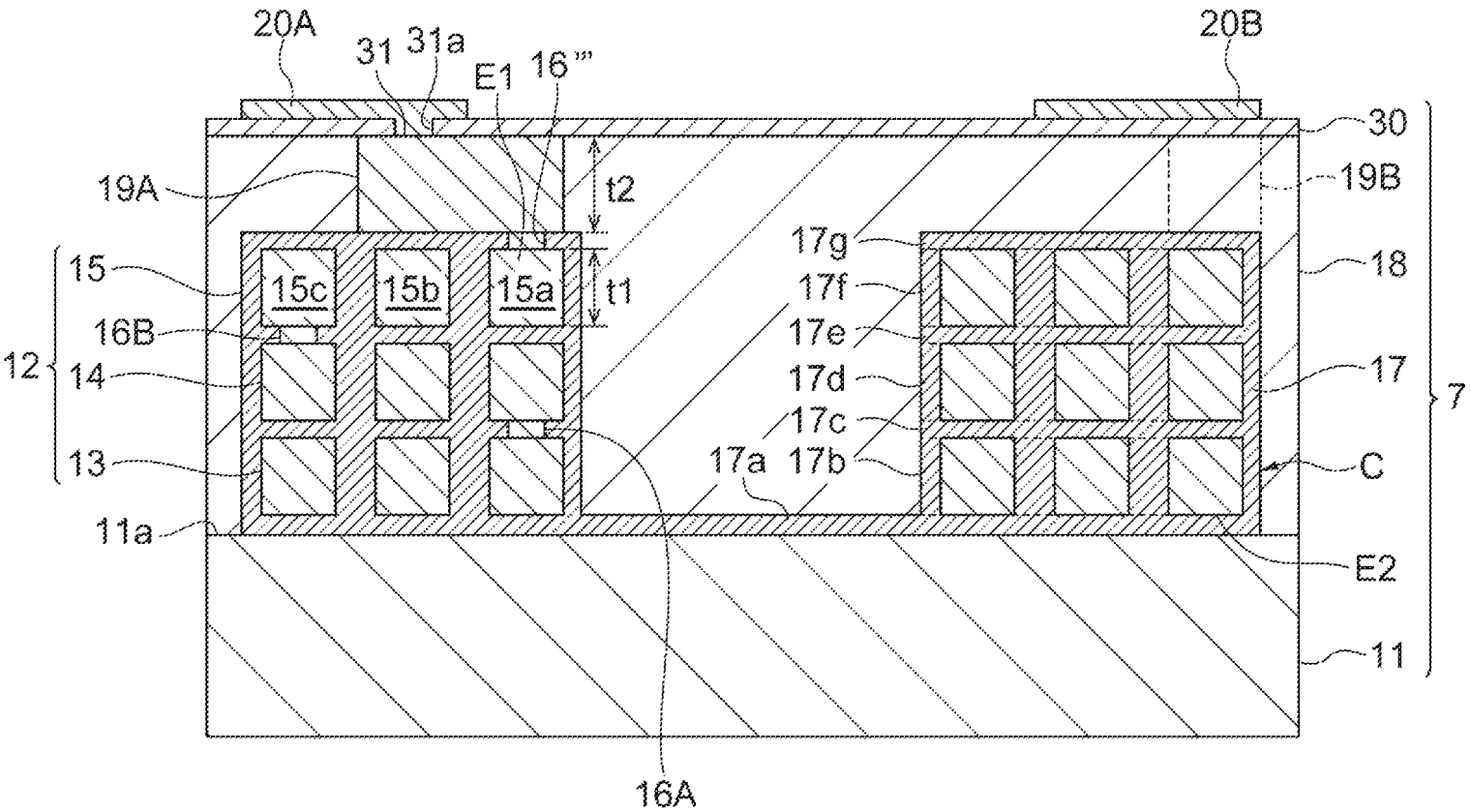
FIG. 4 is a cross-sectional view taken along line IV-IV in FIG. 3.
Figure 5:
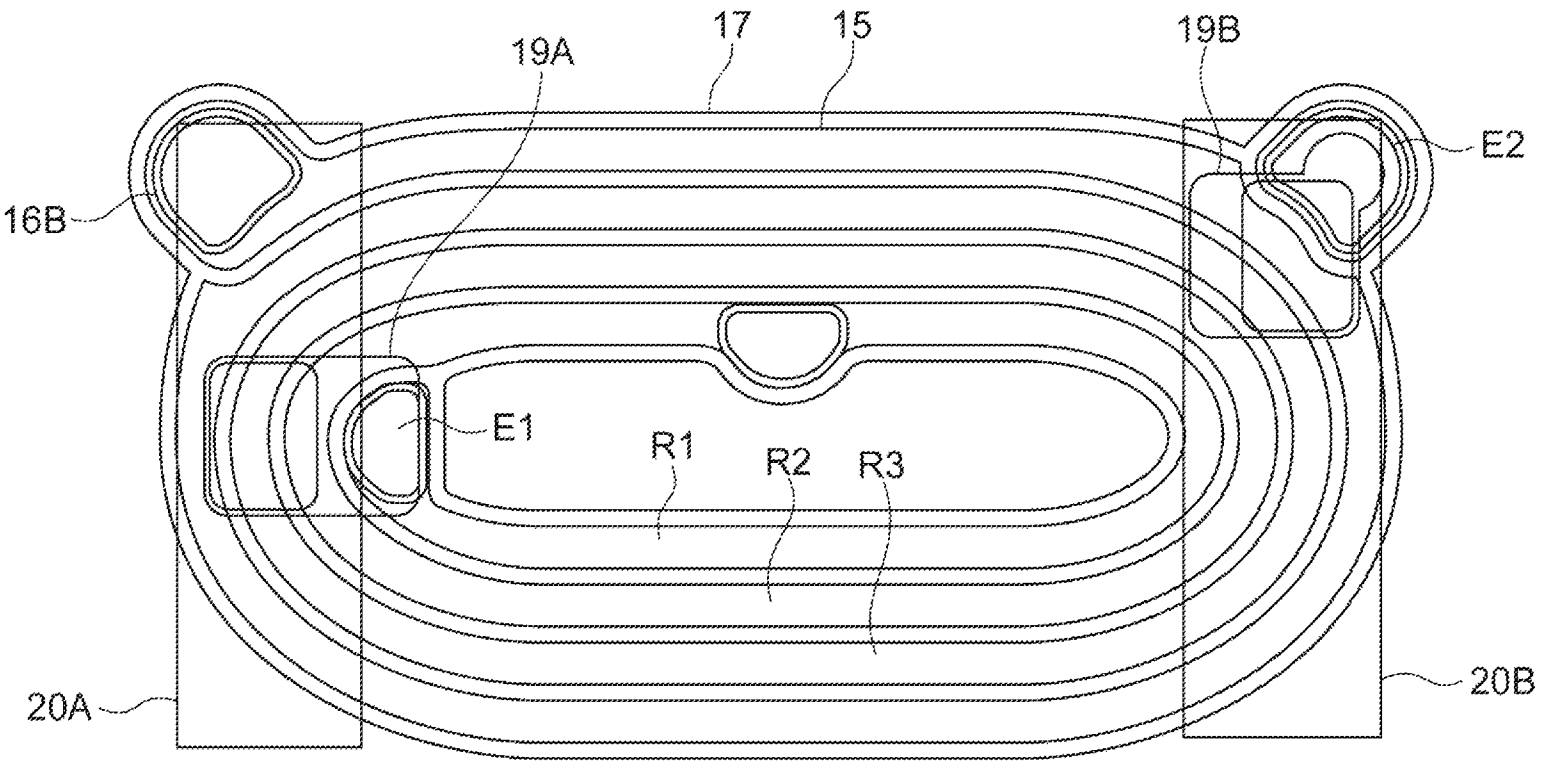
FIG. 5 is a top view illustrating a coil in FIG. 4.

With reference to FIGS. 3 to 5, a configuration of the coil component 10 will be described. FIG. 3 is a perspective view of the coil component 10. FIG. 4 is a cross-sectional view taken along line IV-IV in FIG. 3. FIG. 5 is a top view illustrating a coil in FIG. 4. In FIG. 5, illustration of a magnetic resin layer 18 FIG. 3 is omitted.

As illustrated in FIG. 3, the coil component 10 includes an element body 7 (magnetic element body) internally provided with a coil 12 (which will be described below), and an insulative layer 30 provided on a main surface 7*a* of the element body 7. The element body 7 has a rectangular parallelepiped exterior. Examples of the rectangular parallelepiped shape include a rectangular parallelepiped shape having chamfered corners and ridge portions, and a rectangular parallelepiped shape having rounded corners and ridge portions. The element body 7 has the main surface 7*a*, and the main surface 7*a* is formed into a rectangular shape having long sides and short sides. Examples of the rectangular shape include a rectangle having rounded corners.

The main surface 7*a* is provided with terminal electrodes 20A and 20B via the insulative layer 30. The terminal electrode 20A is disposed along one short side of the main surface 7*a* and the terminal electrode 20B is disposed along the other short side in the main surface 7*a*. The terminal electrodes 20A and 20B are spaced away from each other in a direction along the long side of the main surface 7*a*.

For example, the element body 7 is formed of a magnetic material. Specifically, the element body 7 is constituted of a magnetic substrate 11 and the magnetic resin layer 18.

The magnetic substrate 11 is a substantially flat substrate constituted of a magnetic material. The magnetic substrate 11 is positioned in the element body 7 on a side opposite to the main surface 7*a*. The magnetic resin layer 18 and the coil 12 (which will be described below) are provided on a main surface 11*a* of the magnetic substrate 11.

Specifically, the magnetic substrate 11 is constituted of a ferrite material (for example, a Ni—Zn-based ferrite material). In the present embodiment, a ferrite material constituting the magnetic substrate 11 includes $Fe_2O_3$, NiO, and ZnO as main materials and includes TiO, CoO, $Bi_2O_3$, and $Ca_2O_3$ as additives.

The magnetic resin layer 18 is formed on the magnetic substrate 11 and is internally provided with the coil 12 (which will be described below). A surface on the opposite side of the surface of the magnetic resin layer 18 on the magnetic substrate 11 side constitutes the main surface 7*a* of the element body 7. The magnetic resin layer 18 is a mixture of magnetic powder and a binder resin. Examples of the constituent material of the magnetic powder include iron, carbonyl iron, silicon, cobalt, chromium, nickel, and boron. Examples of the constituent material of the binder resin include an epoxy resin. For example, 90% or more of the magnetic resin layer 18 in its entirety may be constituted of magnetic powder.

Each of a pair of terminal electrodes 20A and 20B provided on the main surface 7*a* of the element body 7 has a film shape and exhibits a substantially rectangular shape in a top view. The terminal electrodes 20A and 20B have substantially the same areas. For example, the terminal electrodes 20A and 20B are constituted of a conductive material such as Cu. In the present embodiment, the terminal electrodes 20A and 20B are plating electrodes formed through plating forming. The terminal electrodes 20A and 20B may have a single layer structure or a multi-layer structure. In a top view, forming regions of the terminal electrodes 20A and 20B and forming regions of lead-out conductors 19A and 19B respectively overlap each other by 50% or more.

As illustrated in FIGS. 4 and 5, the element body 7 of the coil component 10 internally has (specifically, inside the magnetic resin layer 18) the coil 12, a covering portion 17, and the lead-out conductors 19A and 19B.

The coil 12 is a planar coil disposed along a normal direction of the main surface 7*a* of the element body 7. The coil 12 has a plurality of windings. In the present embodiment, the coil 12 is wound as much as approximately three windings. As illustrated in FIG. 5, the coil 12 is wound into a substantially elliptic ring shape in a top view (that is, when seen in a coil axial direction). More specifically, in a top view, the coil 12 exhibits a rounded rectangular ring shape constituted of straight parts and curved parts. For example, the coil 12 is constituted of a metal material such as Cu, and its axial center (coil axis) extends along the normal direction of the main surface 11*a* of the magnetic substrate 11 and the main surface 7*a* of the element body 7 (direction orthogonal to the main surface 11*a* and the main surface 7*a* of the element body 7). The coil 12 is constituted of three coil conductor layers. The coil 12 includes a lower coil portion 13, an intermediate coil portion 14, and an upper coil portion 15 and also includes joining portions 16A and 16B. The lower coil portion 13, the intermediate coil portion 14, and the upper coil portion 15 are arranged in a direction orthogonal to the main surface 7*a* (axial center direction of the coil 12) in this order from that closer to the magnetic substrate 11. All of the lower coil portion 13, the intermediate coil portion 14, and the upper coil portion 15 have the same winding direction, and a current flows in the same direction at a predetermined timing (example, clockwise direction).

The thicknesses of the lower coil portion 13, the intermediate coil portion 14, and the upper coil portion 15 may be the same as each other or may be different from each other. In the present embodiment, the thicknesses of the intermediate coil portion 14 and the upper coil portion 15 are the same as each other (thickness t1).

The joining portion 16A is interposed between the lower coil portion 13 and the intermediate coil portion 14 and connects the innermost winding of the lower coil portion 13 and the innermost winding of the intermediate coil portion 14 with each other. The joining portion 16B is interposed between the intermediate coil portion 14 and the upper coil portion 15 and connects the outermost winding of the intermediate coil portion 14 and the outermost winding of the upper coil portion 15 with each other.

The covering portion 17 has insulating characteristics and is constituted of an insulative resin. Examples of the insulative resin used in the covering portion 17 include polyimide and polyethylene terephthalate. Inside the element body 7, the covering portion 17 integrally covers the lower coil portion 13, the intermediate coil portion 14, and the upper coil portion 15 of the coil 12. The covering portion 17 has a stacked structure. In the present embodiment, the covering portion 17 is constituted of seven insulative resin layers 17*a*, 17*b*, 17*c*, 17*d*, 17*e*, 17*f*, and 17*g*.

The insulative resin layer 17*a* is positioned on a lower side (magnetic substrate 11 side) of the lower coil portion 13 and is formed in substantially the same region as the forming region of the coil 12 in a top view. The insulative resin layers 17*b* fill the periphery and gaps between the windings within the same layer as the lower coil portion 13 and are open in the region corresponding to the inner diameter of the coil 12. The insulative resin layers 17*b* extend along a direction orthogonal to the magnetic substrate 11. The insulative resin layer 17*c* is at a position sandwiched between the lower coil portion 13 and the intermediate coil portion 14 and is open in the region corresponding to the inner diameter of the coil 12. The insulative resin layers 17*d* fill the periphery and gaps between the windings within the same layer as the intermediate coil portion 14 and are open in the region corresponding to the inner diameter of the coil 12. The insulative resin layer 17*e* is at a position sandwiched between the intermediate coil portion 14 and the upper coil portion 15 and is open in the region corresponding to the inner diameter of the coil 12. The insulative resin layers 17*f* fill the periphery and gaps between the windings within the same layer as the upper coil portion 15 and are open in the region corresponding to the inner diameter of the coil 12. The insulative resin layer 17*g* is positioned on an upper side (main surface 7*a* side) of the upper coil portion 15, covers the upper coil portion 15, and is open in the region corresponding to the inner diameter of the coil 12.

In the present embodiment, a coil portion C is constituted of the coil 12 and the covering portion 17 as described above.

For example, a pair of lead-out conductors 19A and 19B is constituted of Cu and extends along a direction orthogonal to the main surface 7*a* from each of both end portions E1 and E2 of the coil 12.

The lead-out conductor 19A is connected to one end portion E1 of the coil 12 provided in the innermost winding of the upper coil portion 15. The lead-out conductor 19A extends from the end portion E1 of the coil 12 to the main surface 7*a* of the element body 7 in a manner penetrating the magnetic resin layer 18 and the insulative resin layer 17*g* and is exposed on the main surface 7*a*. The terminal electrode 20A is provided at a position corresponding to the exposed part of the lead-out conductor 19A. The lead-out conductor 19A is connected to the terminal electrode 20A through a conductor portion 31 inside a through-hole 31*a* of the insulative layer 30. Accordingly, the end portion E1 of the coil 12 and the terminal electrode 20A are electrically connected to each other via the lead-out conductor 19A and the conductor portion 31.

More specifically, as illustrated in FIGS. 4 and 5, the lead-out conductor 19A is provided to cover a winding portion 15*a* (which will hereinafter be referred to as a winding end portion) constituting the end portion E1 of the coil 12, and a winding portion 15*b* (which will hereinafter be referred to as a winding adjacent portion) adjacent to the winding end portion 15*a*. As illustrated in FIG. 4, the lead-out conductor 19A is directly connected to the winding portion 15*a* via an opening portion 16''' of the insulative resin layer 17*g*. The insulative resin layer 17*g* is interposed between the lead-out conductor 19A and the winding portion 15*b*, and the lead-out conductor 19A and the winding portion 15*b* are not directly connected to each other. A thickness t2 of the lead-out conductor 19A is designed to be greater than the thickness t1 of the intermediate coil portion 14 and the upper coil portion 15 (t1<t2).

The lead-out conductor 19B is connected to the other end portion E2 of the coil 12 provided in the outermost winding of the lower coil portion 13. In a form similar to that of the lead-out conductor 19A, the lead-out conductor 19B also extends from the end portion E2 of the coil 12 to the main surface 7*a* of the element body 7 and is exposed on the main surface 7*a*. The terminal electrode 20B is provided at a position corresponding to the exposed part of the lead-out conductor 19B. Accordingly, the end portion E2 of the coil 12 and the terminal electrode 20B are electrically connected to each other via the lead-out conductor 19B.

The insulative layer 30 provided on the main surface 7*a* of the element body 7 is interposed between the pair of terminal electrodes 20A and 20B on the main surface 7*a*. In the present embodiment, the insulative layer 30 is provided to cover the entire region of the main surface 7*a* while exposing the pair of lead-out conductors 19A and 19B, and includes a part which extends in a direction intersecting the long side direction (direction in which the pair of terminal electrodes 20A and 20B is adjacent to each other) and traverses the main surface 7*a*. The insulative layer 30 has through-holes at positions corresponding to the lead-out conductors 19A and 19B. A conductor portion constituted of a conductive material, such as Cu, is provided inside the through-hole. The insulative layer 30 is constituted of an insulative material. For example, the insulative layer 30 is constituted of an insulative resin, such as polyimide and epoxy.

Next, with reference to FIGS. 6A to 6D, 7A to 7D, and 8A to 8D, a method of manufacturing the coil component 10 will be described. FIGS. 6A to 6D, 7A to 7D, and 8A to 8D are views describing steps of manufacturing the coil component 10.

Figure 6A:
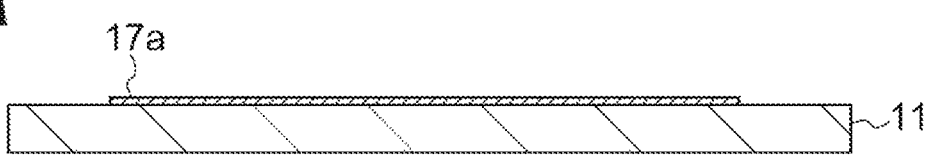
FIGS. 6A to 6D are views describing a step of manufacturing a coil component.
Figure 6B:
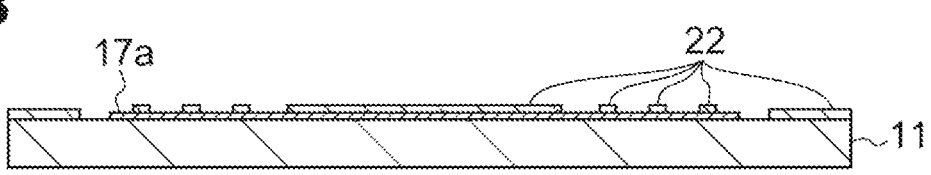
Figure 6C:
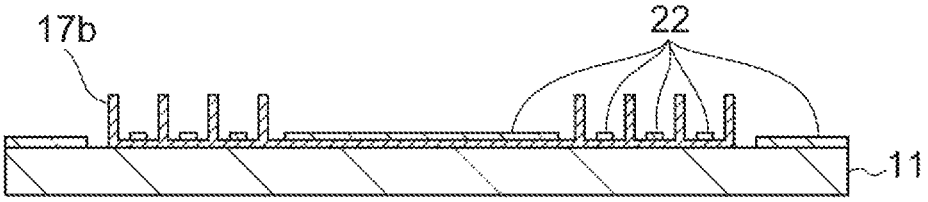
Figure 6D:
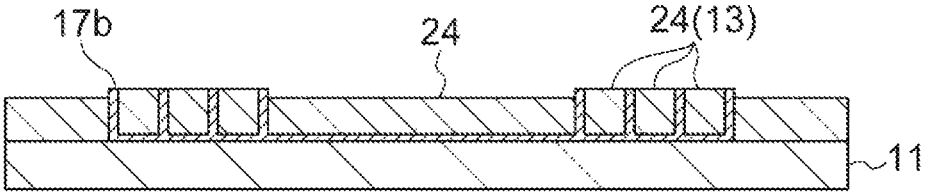

First, as illustrated in FIG. 6A, the above-described magnetic substrate 11 is prepared, and the prepared magnetic substrate 11 is coated with an insulative resin paste pattern, thereby forming the insulative resin layer 17*a* of the covering portion 17. Subsequently, as illustrated in FIG. 6B, seed portions 22 for plating forming of the lower coil portion 13 are formed on the insulative resin layer 17*a*. The seed portions 22 can be formed through plating, sputtering, or the like using a predetermined mask. Subsequently, as illustrated in FIG. 6C, the insulative resin layers 17*b* of the covering portion 17 are formed. The insulative resin layers 17*b* can be obtained by coating the entire surface of the magnetic substrate 11 with an insulative resin paste, and removing parts corresponding to the seed portions 22 thereafter. That is, the insulative resin layers 17*b* have a function of exposing the seed portions 22. The insulative resin layers 17*b* are wall-shaped parts erected on the magnetic substrate 11 and define the regions for forming the lower coil portion 13. Subsequently, as illustrated in FIG. 6D, a plating layer 24 is formed between the insulative resin layers 17*b* using the seed portions 22. In this case, a plated spot which grows in a manner filling the region defined between the insulative resin layers 17*b* becomes the lower coil portion 13. As a result, the winding of the lower coil portion 13 is positioned between the insulative resin layers 17*b* adjacent to each other.

Figure 7A:
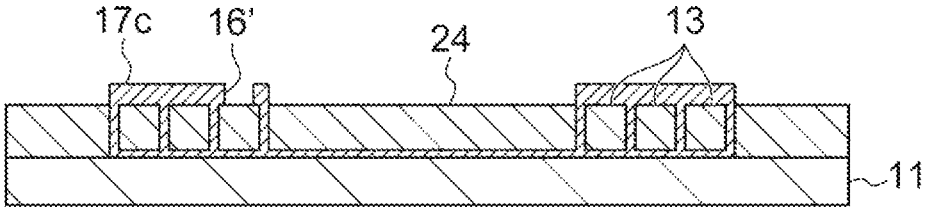
FIGS. 7A to 7D are views describing a step of manufacturing a coil component.
Figure 7B:
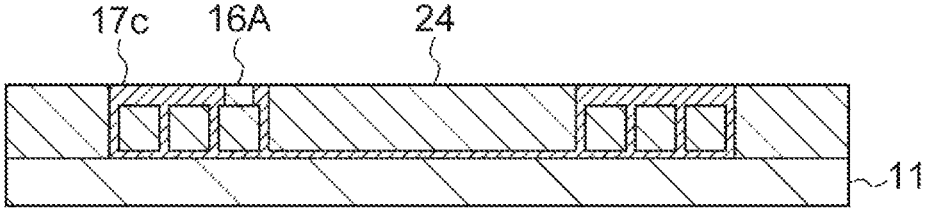

Subsequently, as illustrated in FIG. 7A, the insulative resin layer 17*c* of the covering portion 17 is formed by coating the lower coil portion 13 with an insulative resin paste pattern. In this case, an opening portion 16' for forming the joining portion 16A is formed in the insulative resin layer 17*c*. Subsequently, as illustrated in FIG. 7B, plating forming of the joining portion 16A is performed with respect to the opening portion 16' of the insulative resin layer 17*c*.

Figure 7C:
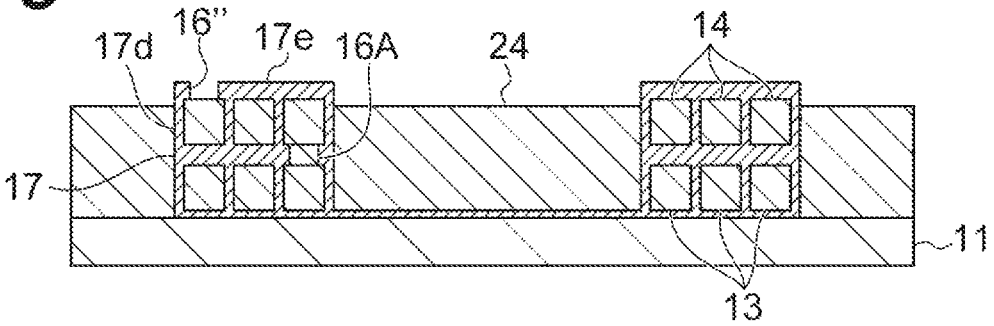

Subsequently, as illustrated in FIG. 7C, similar to the steps described above, the intermediate coil portion 14 and the insulative resin layers 17*d* and 17*e* are formed on the insulative resin layer 17*c* of the covering portion 17. Specifically, similar to the procedure illustrated in FIGS. 6B to 6D, seed portions for performing plating forming of the intermediate coil portion 14 are formed, the insulative resin layers 17*d* defining the region for forming the intermediate coil portion 14 are formed, and plating forming of the intermediate coil portion 14 is performed between the insulative resin layers 17*d*.

Then, the insulative resin layer 17*e* of the covering portion 17 is formed by coating the intermediate coil portion 14 with an insulative resin paste pattern. In this case, an opening portion 16" for forming the joining portion 16B is formed in the insulative resin layer 17*e*. Thereafter, plating forming of the joining portion 16B is performed with respect to the opening portion 16" of the insulative resin layer 17*e*.

Figure 7D:
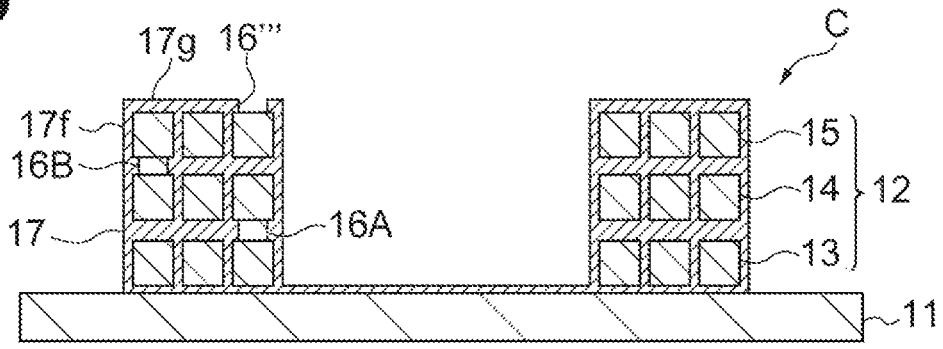

Furthermore, as illustrated in FIG. 7D, similar to the steps described above, the upper coil portion 15 and the insulative resin layers 17*f* and 17*g* of the covering portion 17 are formed in the insulative resin layer 17*e*. Specifically, similar to the procedure illustrated in FIG. 6B to 6D, seed portions for performing plating forming of the upper coil portion 15 are formed, the insulative resin layers 17*f* defining the region for forming the upper coil portion 15 are formed, and plating forming of the upper coil portion 15 is performed between the insulative resin layers 17*f*.

Then, the insulative resin layer 17*g* of the covering portion 17 is formed by coating the upper coil portion 15 with an insulative resin paste pattern. In this case, an opening portion 16'" for forming the lead-out conductor 19A is formed in the insulative resin layer 17*g*. In addition, in the plating layer 24, parts in which the lower coil portion 13, the intermediate coil portion 14, and the upper coil portion 15 are not configured (parts corresponding to the inner diameter portion and the outer circumferential portion of the lower coil portion 13, the intermediate coil portion 14, and the upper coil portion 15) are removed by performing etching. In other words, the plating layer 24 which is not covered with the covering portion 17 is removed.

As described above, the covering portion 17 has a stacked structure including a plurality of insulative resin layers 17*a* to 17*g*, and the lower coil portion 13, the intermediate coil portion 14, and the upper coil portion 15 are surrounded by the insulative resin layers 17*a* to 17*g*. Then, through the step illustrated in FIG. 7D, the coil portion C constituted of the coil 12 and the covering portion 17 is completed.

Figure 8A:
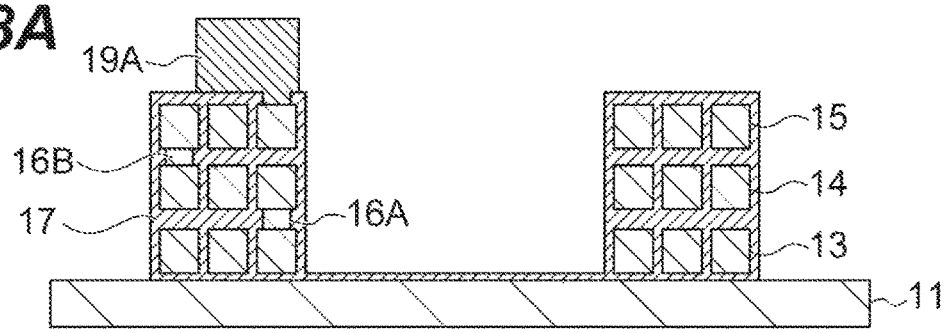
FIGS. 8A to 8D are views describing a step of manufacturing a coil component.

Subsequently, as illustrated in FIG. 8A, the lead-out conductor 19A is formed at a position corresponding to the opening portion 16'" of the insulative resin layer 17*g*. Specifically, the seed portions for forming the lead-out conductor 19A are formed on the opening portion 16'" through plating, sputtering, or the like using a predetermined mask, and plating forming of the lead-out conductor 19A is performed by means of the seed portions. In this case, the lead-out conductor 19A is formed to be connected to the winding portion (winding end portion 15*a*) constituting the end portion E1 of the coil 12, and to cover a winding portion (winding adjacent portion 15*b*) adjacent to the winding portion via the insulative resin layer 17*g*.

Figure 8B:
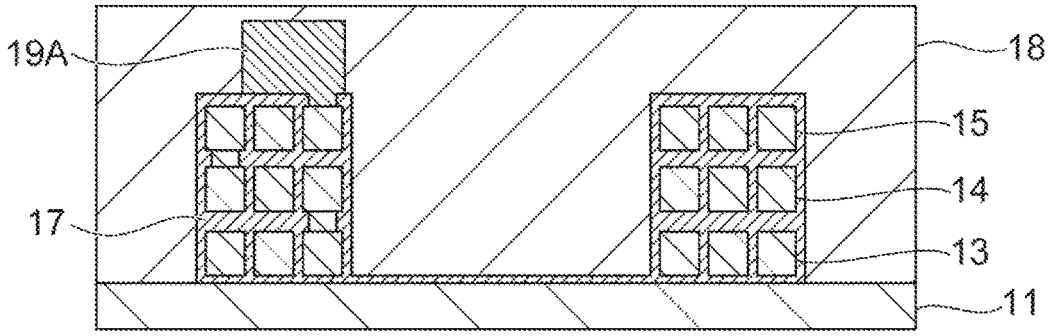

Subsequently, as illustrated in FIG. 8B, the magnetic resin layer 18 is formed by coating the entire surface of the magnetic substrate 11 with a magnetic resin and performing predetermined hardening.

Figure 8C:
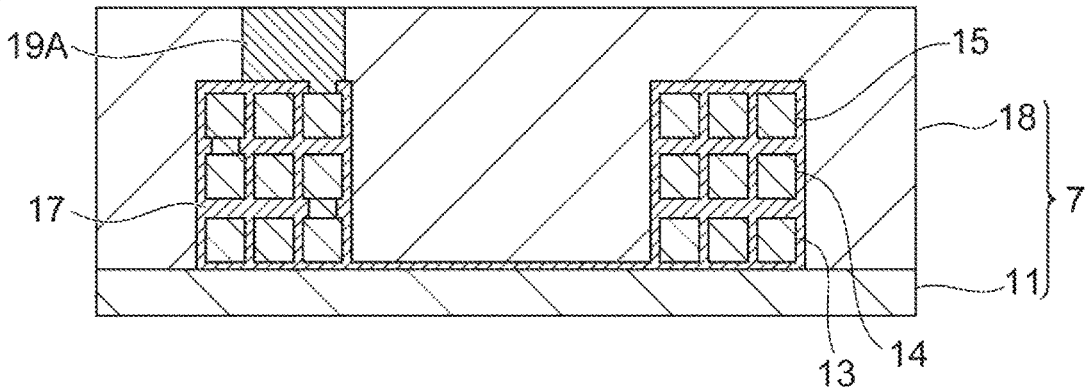

Accordingly, the periphery of the covering portion 17 and the lead-out conductor 19A is covered with the magnetic resin layer 18. In this case, the inner diameter part of the coil 12 is filled with the magnetic resin layer 18. Subsequently, as illustrated in FIG. 8C, polishing is performed such that the lead-out conductor 19A is exposed from the magnetic resin layer 18.

Through the step described above, it is possible to obtain the element body 7 in which the lead-out conductor 19A is exposed from the main surface 7*a* of the element body 7, and the step of preparing the element body 7 ends.

Figure 8D:
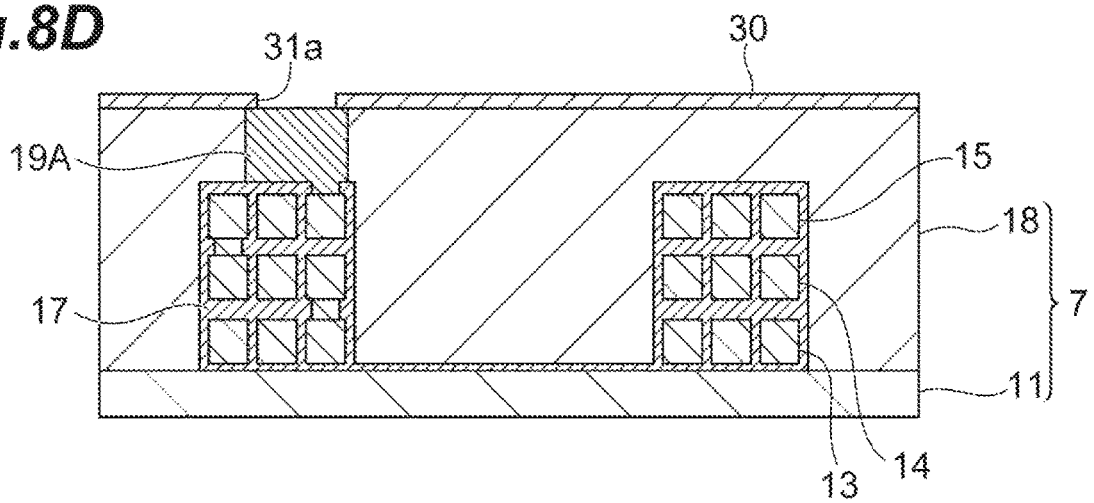

Subsequently, as illustrated in FIG. 8D, before plating forming of the terminal electrode 20A is performed, the main surface 7*a* is coated with an insulative material such as an insulative resin paste, thereby forming the insulative layer 30. When the insulative layer 30 is formed, the entire main surface 7*a* is covered, and the through-hole 31*a* is formed at a position corresponding to the lead-out conductor 19A, thereby causing the lead-out conductor 19A to be exposed from the insulative layer 30. Specifically, for the moment, the entire region of the main surface 7*a* is coated with an insulative material. Thereafter, the insulative layer 30 at a location corresponding to the lead-out conductor 19A is removed.

Then, seed portions (not illustrated) are formed in the regions corresponding to the terminal electrode 20A on the insulative layer 30 through plating, sputtering, or the like using a predetermined mask. The seed portions are also formed on the lead-out conductor 19A exposed from the through-hole 31*a* of the insulative layer 30. Subsequently, the terminal electrode 20A is formed through electroless plating by using the seed portions. In this case, the plated spot grows in a manner filling the through-hole 31*a* of the insulative layer 30, thereby forming the conductor portion 31 and fainting the terminal electrode 20A on the insulative layer 30. In a manner as described above, the coil component 10 is formed.

In FIGS. 6A to 6D, 7A to 7D, and 8A to 8D, only one lead-out conductor 19A of the pair of lead-out conductors is illustrated. The other lead-out conductor 19B is formed in a similar form.

Next, with reference to FIG. 9, heat dissipation of the above-described coil component 10 will be described.

In the coil component 10, since the coil 12 has predetermined electrical resistance, the lower coil portion 13, the intermediate coil portion 14, and the upper coil portion 15 (planar coil) generate heat at the time of operation thereof.

Figure 9:
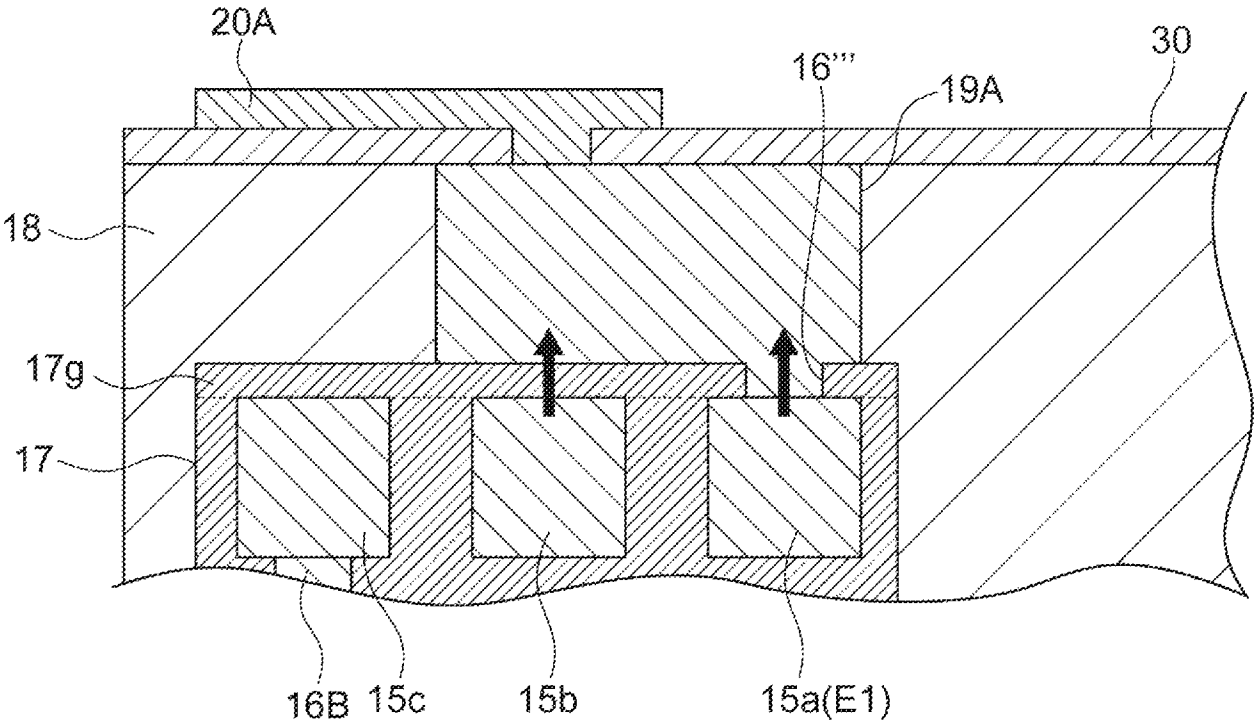
FIG. 9 is an enlarged view of a main portion in the cross-sectional view of the coil component illustrated in FIG. 4.

As illustrated in FIG. 9, in the upper coil portion 15, the winding end portion 15*a* constituting the end portion E1 is connected to the lead-out conductor 19A, the lead-out conductor 19A can absorb heat from the winding end portion 15*a* and can dissipate heat to the outside via the terminal electrode 20A. Moreover, since the lead-out conductor 19A is formed to cover the winding adjacent portion 15*b*, the lead-out conductor 19A can also absorb heat from the winding adjacent portion 15*b* and can dissipate heat to the outside via the terminal electrode 20A. Therefore, as illustrated in FIG. 5, in a case where the upper coil portion 15 is wound in order from a first winding part R1, a second winding part R2, and a third winding part R3 from the inner side, not only heat in the first winding part R1 but also heat in the second winding part R2 can be subjected to heat dissipation to the outside via the lead-out conductor 19A and the terminal electrode 20A.

In a case where the lead-out conductor 19 covers the winding portion 15*c* adjacent to the winding adjacent portion 15*b* on an outer side and covers the plurality of winding portions 15*b*, 15*c* via the insulative resin layer 17*g*, heat in the third winding part R3 can also be dissipated to the outside via the lead-out conductor 19A and the terminal electrode 20A. The lead-out conductor 19 can be provided to cover all of the winding portions in a radial direction of the upper coil portion 15. The lead-out conductor 19 can be provided throughout ¾ or more of the length of the upper coil portion 15 in the radial direction.

As described above, in the above-described coil component 10, since the lead-out conductor 19A absorbs heat not only from the winding end portion 15*a* but also from the winding adjacent portion 15*b*, improvement of heat dissipation properties is realized in the coil component 10. In the coil component 10, since high heat dissipation properties are realized, long life span can be achieved, and high reliability and characteristic stability can be acquired.

As illustrated in FIG. 5, the lead-out conductor 19B lead out from the end portion E2 can also be provided to cover the windings corresponding to the first winding part R1, the second winding part R2, and the third winding part R3 of the upper coil portion 15. In this case, heat of the upper coil portion 15 can be dissipated to the outside via the lead-out conductor 19B and the terminal electrode 20B, so that heat dissipation properties of the coil component 10 can be further improved.

In addition, in the coil component 10, since the thickness t2 of the lead-out conductor 19A is greater than the thickness t1 of the upper coil portion 15, the lead-out conductor 19A has a high thermal capacity. Due to the high thermal capacity of the lead-out conductor 19A, efficiency of heat transfer from the upper coil portion 15 toward the lead-out conductor 19A is enhanced. As a result, heat of the upper coil portion 15 is efficiently dissipated to the outside via the terminal electrode 20A.

Hereinabove, the embodiment of the present disclosure has been described. However, the present disclosure is not limited to the embodiment and may be changed or differently applied in a range not changing the gist disclosed in each of the aspects.

Figure 10:
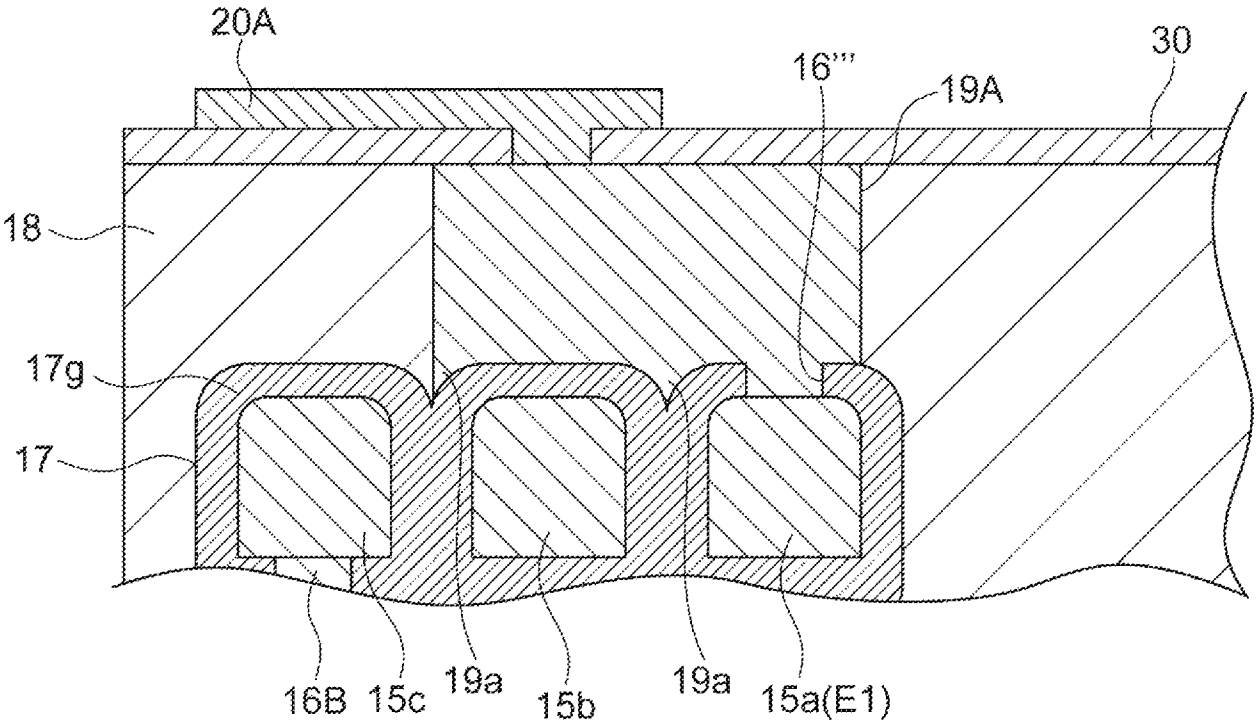
FIG. 10 is a view illustrating a lead-out electrode of a coil component having a different form.

For example, the shape of a lead-out conductor can be suitably changed. For example, it is possible to employ a lead-out conductor having a cross-sectional shape as illustrated in FIG. 10. The lead-out conductor 19A illustrated in FIG. 10 has blade-shaped projections 19*a* which each extend to enter a part between winding adjacent portions among the winding portions 15*a*, 15*b*, and 15*c* in the upper coil portion 15. Such a lead-out conductor 19A can absorb heat from the winding end portion 15*a* and the winding adjacent portion 15*b* and can dissipate heat to the outside via the terminal electrode 20A. Moreover, compared to the lead-out conductor 19A having the form described above, the area facing each of the winding portions in the upper coil portion 15 is widened, so that the quantity of heat absorbed through the upper coil portion 15 has increased. Therefore, further improved heat dissipation properties can be realized. The projection 19*a* of the lead-out conductor 19A can be formed by providing a winding portion of the upper coil portion 15 having a curved apex, and forming the insulative resin layer 17*g* to follow the shape of the apex. The shape of the projection 19*a* of the lead-out conductor 19A is not limited to a blade shape. A hemispherical shape, a conical shape, or a trapezoidal shape may be applied.

In addition, the cross-sectional shape or the end surface shape of the lead-out conductor can also be suitably changed. A cylindrical lead-out conductor or a prismatic lead-out conductor can be employed.

Furthermore, in the embodiment described above, a magnetic element body constituted of a magnetic substrate and a magnetic resin layer has been illustrated. However, a form in which a magnetic element body includes no magnetic substrate may be applied.

In addition, a form in which the thickness of a lead-out conductor is smaller than the thickness a planar coil (for example, the upper coil portion described above) may be applied. In this case, since the distance between the planar coil (heat source) and the coil component with respect to the outside (specifically, the distance in a thickness direction of the component) is shortened, heat of the planar coil is likely to be dissipated to the outside.

What is claimed is:

1. A coil component comprising:

a magnetic element body having a main surface and having a coil and a pair of lead-out conductors internally, the coil including a coil portion, the coil portion including two coil end portions, the pair of lead-out conductors extending along a coil axial direction of the coil portion respectively from both coil end portions of the coil portion to the main surface so as to penetrate the magnetic element body and being exposed on the main surface of the magnetic element body;
and a pair of terminal electrodes provided on the main surface of the magnetic element body and connected electrically to the pair of lead-out conductors, respectively, exposed on the main surface, wherein the coil has a planar coil having a plurality of windings including the two coil end portions and constituting at least a part of the coil portion, and an insulative layer formed on the coil portion, at least one of the lead-out conductor penetrates the insulative layer, is connected to a winding end portion of one of the coil end portions, and covers at least a part of a winding adjacent portion that is of the one of the coil end portions and is adjacent to the winding end portion, via the insulative layer, and the at least one of the pair of lead-out conductors has projections, at least one of the projections extending to enter a part between the winding end portion and the winding adjacent portion.

2. The coil component according to claim 1, wherein the at least one lead-out conductor covers a plurality of winding portions including the winding adjacent portion, via the insulative layer.

3. The coil component according to claim 1, wherein a thickness of the at least one lead-out conductor is greater than a thickness of the planar coil.

4. The coil component according to claim 1, wherein the planar coil exhibits an annular shape including a straight part and a curved part when seen in the coil axial direction of the coil, and wherein the one of the coil end portions connected to the at least one lead-out conductor is positioned at the curved part of the planar coil.

5. The coil component according to claim 1, wherein the at least one of the projections has a blade shape.

* * * * *